US005823294A

United States Patent [19]

Mizutani et al.

[11] Patent Number: 5,823,294

[45] Date of Patent: Oct. 20, 1998

[54] LUBRICATION MECHANISM IN COMPRESSOR

[75] Inventors: Hideki Mizutani; Hiroaki Kayukawa; Suguru Hirota; Fuminobu Enokijima, all of Kariya, Japan

[73] Assignee: Kabushiki Kaisha Toyoda Jidoshokki Seisakusho, Kariya, Japan

[21] Appl. No.: 869,656

[22] Filed: Jun. 5, 1997

[30] Foreign Application Priority Data

Jun. 6, 1996 [JP] Japan ..... 8-144432

[51] Int. Cl.[6] ..... F01M 9/00

[52] U.S. Cl. ..... 184/6.3; 184/6.17; 92/79; 92/154; 417/269

[58] Field of Search ..... 92/12.2, 71, 79, 92/154; 184/6.3, 6.17; 417/269

[56] References Cited

U.S. PATENT DOCUMENTS

| | | | |
|---|---|---|---|
| 4,283,997 | 8/1981 | Takahashi et al. | 92/79 |
| 4,290,345 | 9/1981 | Hiraga et al. | 92/79 |
| 4,392,788 | 7/1983 | Nakamura et al. | 92/79 |
| 4,401,414 | 8/1983 | Ishizuka | 417/269 |
| 4,815,943 | 3/1989 | Kawashima et al. | 417/269 |
| 5,088,897 | 2/1992 | Kawai et al. | 184/6.17 |
| 5,518,374 | 5/1996 | Ota et al. | 417/222.2 |
| 5,580,224 | 12/1996 | Ikeda et al. | 184/6.17 |
| 5,636,974 | 6/1997 | Ikeda et al. | 417/269 |

FOREIGN PATENT DOCUMENTS

| | | |
|---|---|---|
| 56-29080 | 3/1981 | Japan . |
| 319472 | 2/1991 | Japan . |

*Primary Examiner*—Thomas E. Denion
*Attorney, Agent, or Firm*—Brooks Haidt Haffner & Delahunty

[57] ABSTRACT

A compressor compresses gas containing misted oil. The compressor has a drive plate located in a crank chamber and mounted on a drive shaft and a piston operably coupled to the drive plate and located in a cylinder bore. The drive plate converts rotation of the drive shaft to reciprocating movement of the piston in the cylinder bore to vary the capacity of the cylinder bore. The piston compresses gas supplied to the cylinder bore and discharges the compressed gas from the compressor by way of a discharge chamber and a discharge passage. An oil separating mechanism is disposed midway in the discharge passage to separate the oil from the gas flowing in the discharge passage. A storing chamber is defined in the lower portion of the separating mechanism to store the oil separated from the gas. A supplying passage connects the storing chamber with the crank chamber to supply the oil to the crank chamber from the storing chamber. A supplying valve is disposed midway in the supplying passage. The supplying valve opens the supplying passage to supply the oil to the crank chamber from the storing chamber when the compressor is stopped.

20 Claims, 5 Drawing Sheets

LUBRICATION MECHANISM IN COMPRESSOR

BACKGROUND OF THE INVENTION

1. Field of the Invention

The present invention relates to compressors that are used in vehicle air conditioners. More particularly, the present invention pertains to a mechanism for effectively lubricating the parts in a compressor.

2. Description of the Related Art

Compressors employed in vehicle air conditioners typically introduce refrigerant gas from an external refrigerant circuit and compress the introduced gas. The compressor then discharges the compressed refrigerant gas to the external refrigerant circuit. The refrigerant gas contains misted lubricant. The lubricant is circulated in the compressor with the flow of refrigerant gas, thereby lubricating each sliding part in the compressor. If the refrigerant gas discharged to the external refrigerant circuit contains an excessive amount of lubricant, the amount of lubricant in the compressor becomes insufficient. This may cause lubrication failure in the compressor. Further, the lubricant in the discharged refrigerant gas adheres to the inside of the condenser and the evaporator and degrades their host exchange efficiency. The refrigeration efficiency of the air conditioner is deteriorated, accordingly.

The present applicant disclosed a compressor in Japanese Unexamined Patent Publication No. 3-19472 for coping with the above drawback. The compressor includes a lubricant separating mechanism for separating lubricant from the refrigerant gas discharged from the compressor and a storing chamber for storing the separated lubricant. When the amount of lubricant in the storing chamber reaches a predetermined level, a float valve is opened for supplying the lubricant to the crank chamber in the compressor through a supply passage. The lubricant supplied to the crank chamber lubricates each sliding part in the crank chamber.

When the compressor stops operating, the refrigerant gas in the external refrigerant circuit is liquefied and enters the compressor. If the compressor is restarted in this state, the lubricant in the compressor leaks out to the external refrigerant circuit with the liquefied refrigerant. The lubricant that has leaked out to the external refrigerant circuit remains in the circuit for a relatively long period of time before returning to the compressor. Therefore, when the compressor starts operating, lubrication in the compressor tends to be insufficient. It is thus required that a sufficient amount of lubricant be stored in the crank chamber when the compressor is started. However, in the compressor of the above publication, lubricant is not supplied to the crank chamber from the storing chamber until the amount of lubricant in the storing chamber reaches a predetermined level. This structure often fails to store a sufficient amount of lubricant in the crank chamber when the compressor is started.

SUMMARY OF THE INVENTION

Accordingly, it is an objective of the present invention to provide a lubricating mechanism for a compressor that prevents lubrication failure when the compressor is started.

To achieve the above objective, the present invention discloses a compressor for compressing gas containing misted oil. The compressor has a drive plate located in a crank chamber and mounted on a drive shaft and a piston operably coupled to the drive plate and located in a cylinder bore. The drive plate converts rotation of the drive shaft to reciprocating movement of the piston in the cylinder bore to vary the capacity of the cylinder bore. The piston compresses gas supplied to the cylinder bore and discharges the compressed gas from the compressor by way of a discharge chamber and a discharge passage. An oil separating mechanism is disposed midway in the discharge passage to separate the oil from the gas flowing in the discharge passage. A storing chamber is defined in the lower portion of the separating mechanism to store the oil separated from the gas. A supplying passage connects the storing chamber with the crank chamber to supply the oil to the crank chamber from the storing chamber. A supplying valve is disposed midway in the supplying passage. The supplying valve opens the supplying passage to supply the oil to the crank chamber from the storing chamber when the compressor is stopped.

BRIEF DESCRIPTION OF THE DRAWINGS

The features of the present invention that are believed to be novel are stet forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A first embodiment of a single-headed piston type variable displacement compressor according to the present invention will now be described with reference to FIGS. 1 to 7.

Figure 1:
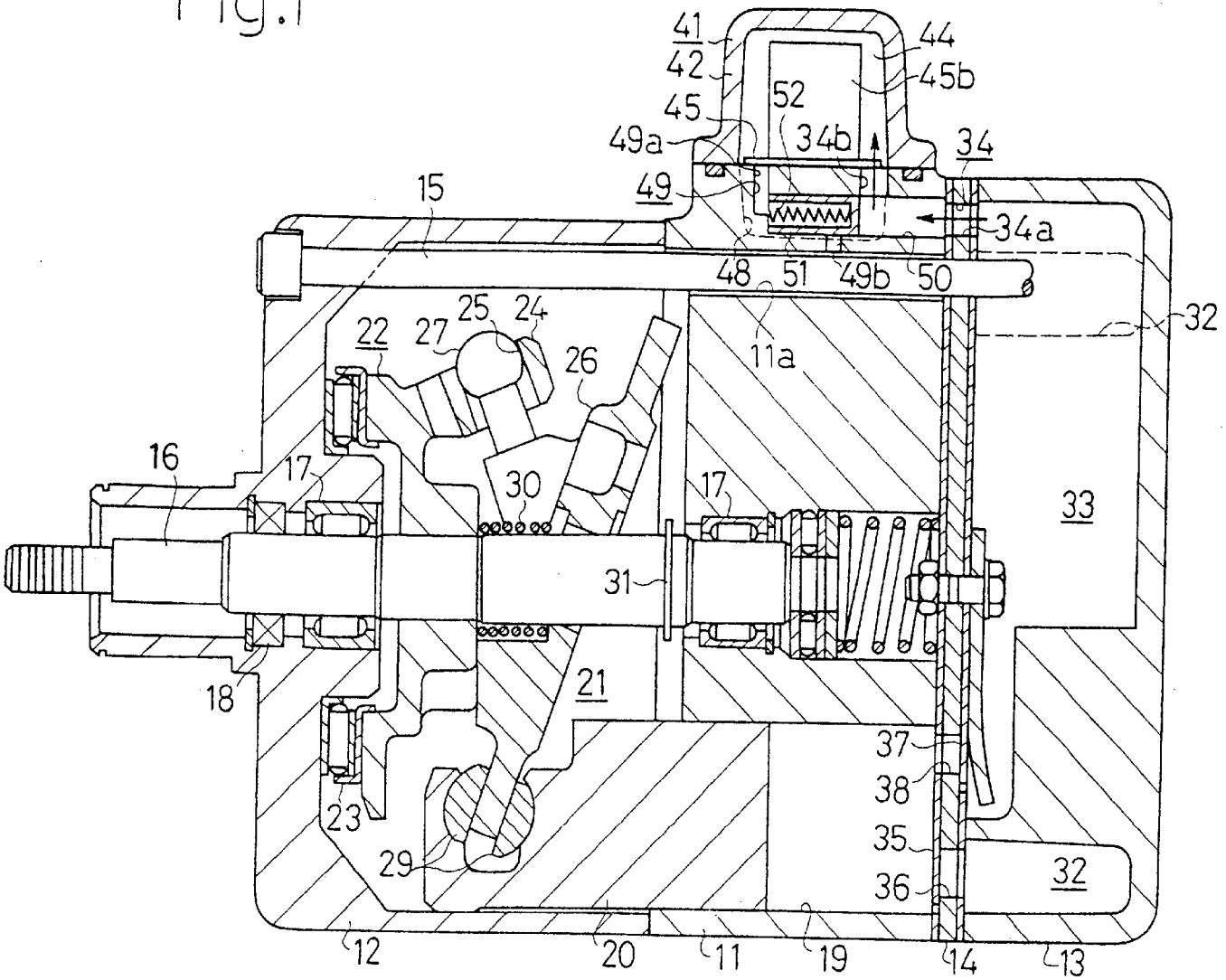
FIG. 1 is a cross-sectional view illustrating a compressor according to a first embodiment of the present invention.

As shown in FIG. 1, a cylinder block 11 consists of a part of the housing of the compressor. A front housing 12 is secured to the front end face of the cylinder block 11. A rear housing 13 is secured to the rear end face of the cylinder block 11 with a valve plate 14 provided in between. A crank chamber 21 is defined by the inner walls of the front housing 12 and the front end face of the cylinder block 11. A plurality of bolts 15 extend through the front housing 12, the cylinder block 11, and the valve plate 14 and are screwed into the rear housing 13. The bolts 15 fasten the front housing 12 and the rear housing 13 to the front and rear end faces of the cylinder block 11. A plurality of through holes 11*a* are formed in the cylinder block 11 through which the bolts 15 pass. The diameter of the through holes 11*a* is a little wider than that of the bolts 15.

A rotary shaft 16 is rotatably supported in the center of the front housing 12 and the cylinder block 11 with a pair of radial bearings 17. A lip seal 18 is located between the rotary shaft 16 and the front housing 12 for sealing the crank chamber 21. The rotary shaft 16 is connected to an external power source such as an engine (not shown) by an electromagnetic clutch and is rotated by the power source.

A rotor 22 is fixed to the rotary shaft 16 and is accommodated in the crank chamber 21. The rotor 22 integrally rotates with the rotary shaft 16. A thrust bearing 23 is placed between the front end face of the rotor 22 and the inner wall of the front housing 12. A support arm 24 is formed at the outer peripheral section of the rotor 22 and protrudes rearward. A pair of guide holes 25 are formed in the support arm 24.

A substantially disk-like swash plate 26 is supported by the rotary shaft 16 in the crank chamber 21 as to be slidable along and tiltable with respect to the axis of the shaft 16. As shown in FIG. 1, the swash plate 26 is provided with a pair of guide pins 27, each having a guide ball. Each guide pin 27 is slidably fitted into the corresponding guide hole 25 formed in the support arm 24. The cooperation of the arm 24 and the guide pins 27 permits the swash plate 26 to rotate together with the rotary shaft 16. The cooperation also guides the tilting of the swash plate 26 and the movement of the swash plate 26 along the axis of the rotary shaft 16. As the swash plate 26 slides toward the cylinder block 11, or rearward, the inclination of the swash plate 26 decreases.

A coil spring 30 is provided about the rotary shaft 16 between the rotor 22 and the swash plate 26. The spring 30 urges the swash plate 26 rearward, or in a direction to decrease the inclination of the swash plate 26. A stopper 31 is fixed to the rotary shaft 16 for limiting the sliding motion of the swash plate 26. The abutment of the swash plate 26 with the stopper 31 defines the minimum inclination of the swash plate 26 by preventing the inclination of the plate 26 from being further decreased.

A plurality of cylinder bores 19 are defined extending through the cylinder block 11 about the rotary shaft 16. The boxes 19 are arranged parallel to the axis of the rotary shaft 16 with a predetermined interval between each adjacent pair of bores 19. A single-handed piston 20 is housed in each bore 19 and reciprocates in the bore 19. A pair of semispherical shoes 29 are fitted between each piston 20 and the swash plate 26. The semispherical portion and a flat portion are defined on each shoe 29. The semispherical portion slidably contacts the piston 20 while the flat portion slidably contacts the swash plate 26. The swash plate 26 rotates integrally with the rotary shaft 16. The rotating movement of the swash plate 26 is transmitted to each piston 20 through the shoes 29 and is converted into a linear reciprocating movement of each piston 20 in the associated cylinder bore 19.

The inclination of the swash plate 26 is changed in accordance with the difference between the pressure in the crank chamber 21 and the pressure in the cylinder bore 19. The compressor of FIG. 1 has a control valve (not shown) for controlling the pressure in the crank chamber 21 in accordance with conditions such as cooling load. Changes in the swash plate's inclination alters the stroke of the pistons 20. This varies the displacement of the compressor.

Figure 4:
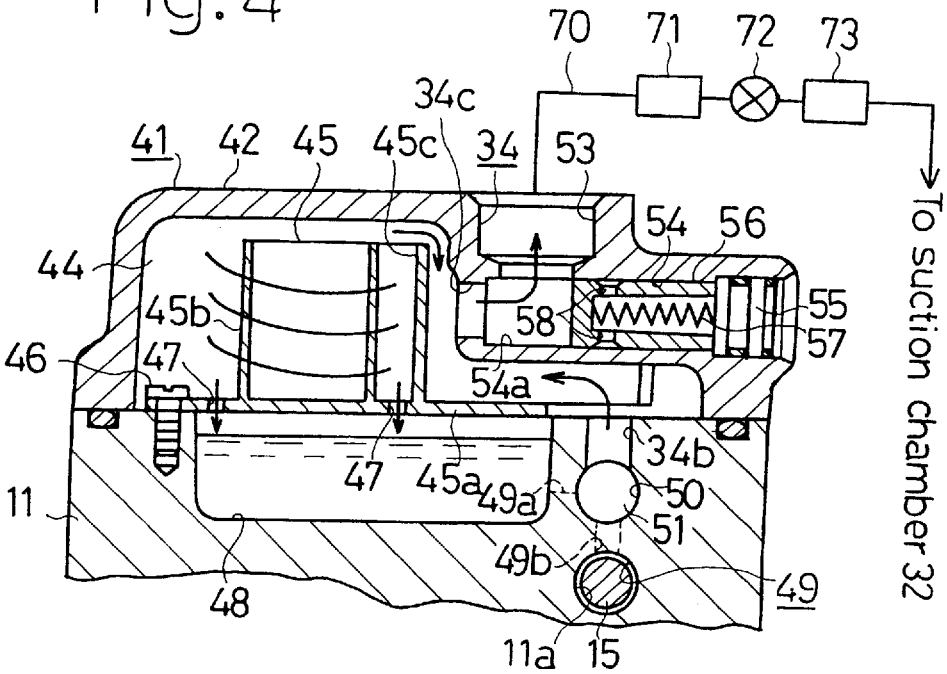
FIG. 4 is a cross-sectional view taken along line 4—4 of FIG. 2.

An annular suction chamber 32 is defined in the peripheral portion of the rear housing 13. The suction chamber 32 is connected to an external refrigerant circuit 70 (see FIG. 4) by a suction passage (not shown). A discharge chamber 33 is defined in the center portion of the rear housing 13. As shown in FIG. 4, the discharge chamber 33 is connected to the external refrigerant circuit 70 by a discharge passage 34. The external refrigerant circuit 70 includes a condenser 71, an expansion valve 72 and an evaporator 73.

Suction ports 36 and discharge ports 38 are formed on the valve plate 14. Each suction port 36 and each discharge port 38 correspond to one of the cylinder bores 19. Suction valves 35 are formed on the valve plate 14, each corresponding to one of the suction ports 36. Similarly, discharge valves 37 are formed on the valve plate 14, each corresponding to one of the discharge ports 38. As each piston 20 moves from the top dead center to the bottom dead center in the associated cylinder bore 19, refrigerant gas in the suction chamber 32 is drawn into the cylinder bore 19 through the associated suction port 36 and the associated suction valve 35. As each piston 20 moves from the bottom dead center to the top dead center in the associated cylinder bore 19, refrigerant gas is compressed in the cylinder bore 19 and is discharged to the discharge chamber 33 through the associated discharge port 38 and the associated discharge valve 37.

As shown in FIGS. 1 to 4, a lubricant separating mechanism 41 is formed in the top peripheral portion of the cylinder block 11 and is located in the discharge passage 34. The mechanism 41 includes a case 42 that is secured to the top of the cylinder block 11 by a pair of bolts 43. A separation chamber 44 is defined in the case 42. The discharge passage 34 includes a first port 34*a*, a valve hole 50 and a second port 34*b*. The first port 34*a* is formed in the valve plate 14 and communicates with the discharge chamber 33. The horizontally extended valve hole 50 is formed in the cylinder block 11 and communicates with the first port 34*a*. The vertically extended second port 34*b* is formed in the cylinder block 11 for connecting the valve hole 50 with the separation chamber 44.

A lubricant separator 45 is accommodated in the separation chamber 44 and secured to the top of the cylinder block 11 by a pair of screws 46. The separator 45 includes a base plate 45*a*, a lubricant separating cylinder 45*b* formed on the base plate 45*a*, and a guide wall 45*c*. A plurality of through holes 47 are formed in the plate 45*a* about the cylinder 45*b* with a predetermined interval between each pair of adjacent holes 47.

When the compressor is operating, compressed refrigerant gas in the discharge chamber 33 is sent to the separation chamber 44 via the first port 34*a*, the valve hole 50 and the second port 34*b*. The refrigerant gas in the separation chamber 44 is led along the guide wall 45*c* of the lubricant separator 45 to the periphery of the separating cylinder 45*b* and revolves around the cylinder 45*b*. Centrifugation caused by the revolution separates misted lubricant from the refrigerant gas in the separation chamber 44.

A recess 48 is formed in the top portion of the cylinder block 11 directly below the lubricant separator 45. The recess 48 functions as a lubricant storing chamber 48. The lubricant separated from refrigerant gas in the separation chamber 44 drips into the storing chamber 48 via the through holes 47 and the clearance about the plate 45*a* and is stored in the chamber 48.

A lubricant supplying passage 49 is formed in the cylinder block 11 for communicating the storing chamber 48 with the crank chamber 21. The passage 49 includes a connecting groove 49*a*, the valve hole 50, a connecting hole 49*b* and one of the through holes 11*a*. The connecting groove 49*a* communicates the storing chamber 48 with the valve hole 50. The connecting hole 49*b* communicates the valve hole 50 with one of the through holes 11*a*. The diameter of the through holes 11*a* is larger than that of the bolts 15. The connecting hole 49*b* is thus communicated with the crank chamber 21 by the space between the bolt 15 and associated through hole 11*a*.

A cylindrical lubricant supplying valve includes a valve member 51 having a closed end. The valve member 51 is slidably accommodated in the valve hole 50. The closed end of the valve member 51 faces the first port 34*a*. A spring 52 engages the valve member 51 and urges it away from the connecting groove 49*a,* or rightward as viewed in FIG. 2. The valve employing the valve member 51 is a spool valve that is operated based on the difference between the pressure in the discharge chamber 33 and the pressure in the storing chamber 48.

Figure 2:
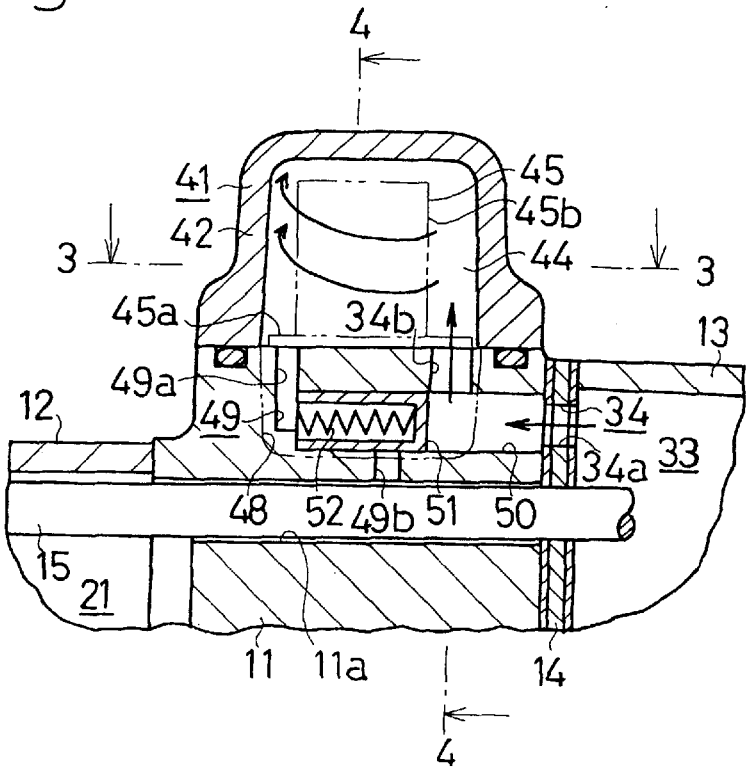
FIG. 2 is an enlarged partial cross-sectional view illustrating a lubricant separating mechanism when the compressor is operating.
Figure 3:
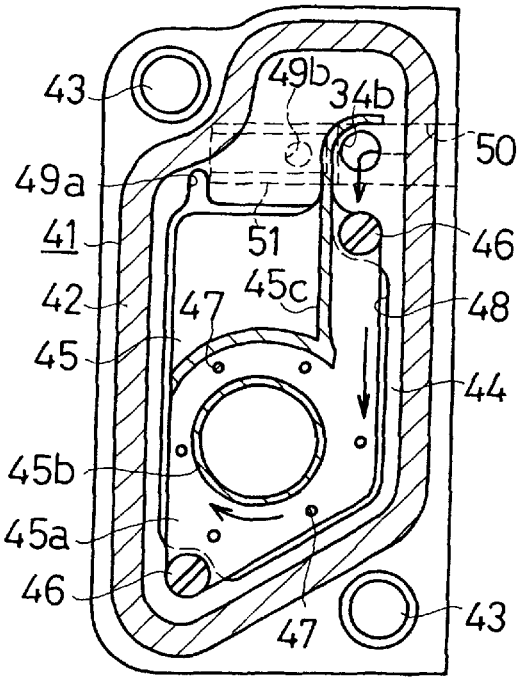
FIG. 3 is a cross-sectional view taken along line 3—3 of FIG. 2.

When the compressor is operating, refrigerant gas flows from the discharge chamber 33 to the first port 34*a* of the discharge passage 34. The pressure of the gas acts on the closed end of the lubricant supplying valve member 51. As shown in FIGS. 1 to 3, the pressure moves the valve member 51 toward the connecting groove 49*a* against the force of the spring 52. As it is moved toward the groove 49*a,* the valve member 51 permits communication between the first port 34*a* and the second port 34*b* via the valve hole 50. This allows refrigerant gas to flow from the discharge chamber 33 into the separation chamber 44 through the discharge passage 34. At the same time, the valve member 51 disconnects the connecting groove 49*a* from the connecting hole 49*b*. This prevents the lubricant in the storing chamber 48 from being supplied to the crank chamber 21.

Figure 5:
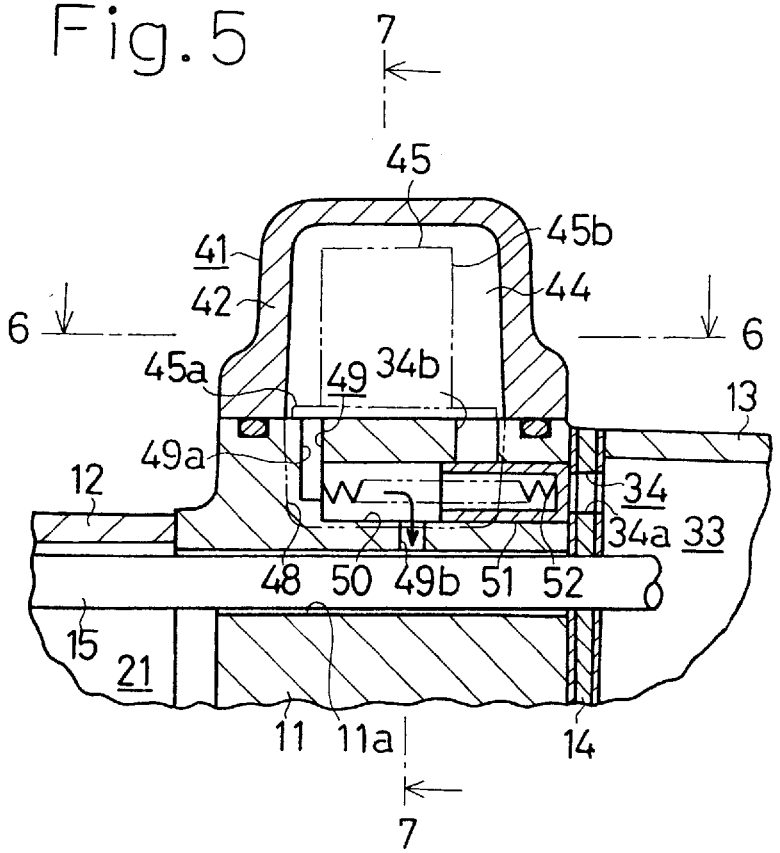
FIG. 5 is an enlarged partial cross-sectional view illustrating a lubricant separating mechanism when the compressor is not operating.
Figure 6:
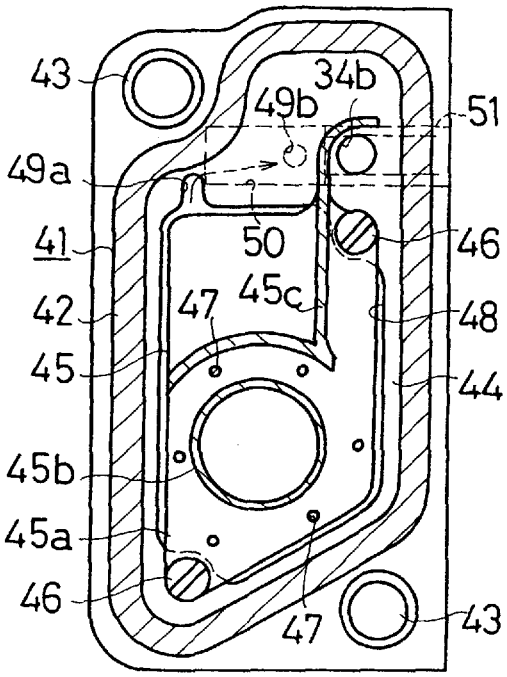
FIG. 6 is a cross-sectional view taken along line 6—6 of FIG. 5.

When the compressor is stopped, refrigerant gas is not discharged from the cylinder bores 19 to the discharge chamber 33. The pressure in the discharge chamber 33 is thus lowered. Accordingly, the pressure acting on the closed end of the valve member 51 is lowered. As a result, the valve member 51 is moved away from the groove 49*a* by the force of the spring 52 as shown in FIGS. 5 and 6. This causes the valve member 51 to disconnect the first port 34*a* from the second port 34*b*. Therefore, the discharge chamber 33 is disconnected from the separation chamber 44. At the same time, the valve member 51 permits communication between the groove 49*a* and the connecting hole 49*b* through the valve hole 50. This allows the lubricant in the storing chamber 49 to be supplied to the crank chamber 21 through the lubricant supplying passage 49.

As shown in FIG. 4, the discharge passage 34 further includes a third port 34*c,* a valve hole 54 and an outlet port 53. The horizontal third port 34*c* is formed in the case 42 and communicates with the separation chamber 44. The horizontally extended valve hole 54 is also formed in the case 42 and communicates with the third port 34*c*. The vertical outlet port 53 is formed in the case 42 and communicates with the valve hole 54. The vertical outlet port 53 is connected to the external refrigerant circuit 70. The valve hole 54 includes an outer portion, which is closed by a plug 55, and an inner portion 54*a,* which communicates the third port 34*c* with the outlet port 53.

The third port 34*c* and the outlet ports 53 are arranged to be perpendicular with respect to each other. In other words, the discharge passage 34, which is located in the downstream portion of the lubricant separating mechanism 41, includes a right angle turn at the inner portion 54*a* of the valve hole 54. A valve having a cylindrical check valve member 56, which has a closed end, is slidably accommodated in the valve hole 54. The closed end of the check valve member 56 faces the inner portion 54*a* of the valve hole 54, or the right angle turn of the discharge passage 34. A spring 57 engages the check valve member 56 and urges the check valve member 56 toward the third port 34*c,* or leftward as viewed in FIG. 4.

When the compressor is operating, refrigerant gas flows from the separation chamber 44 to the third port 34*c* of the discharge passage 34. The pressure of the gas acts on the closed end of the check valve member 56. As shown in FIG. 4, the pressure moves the check valve member 56 away from the third port 34*c* against the force of the spring 57. As it is moved away from the third port 34*c,* the valve member 56 permits communication between the third port 34*c* and the outlet port 53 via the inner portion 54*a* of the valve hole 54. This allows refrigerant gas to be discharged from the separation chamber 44 to the external refrigerant circuit 70 via the discharge passage 34.

Figure 7:
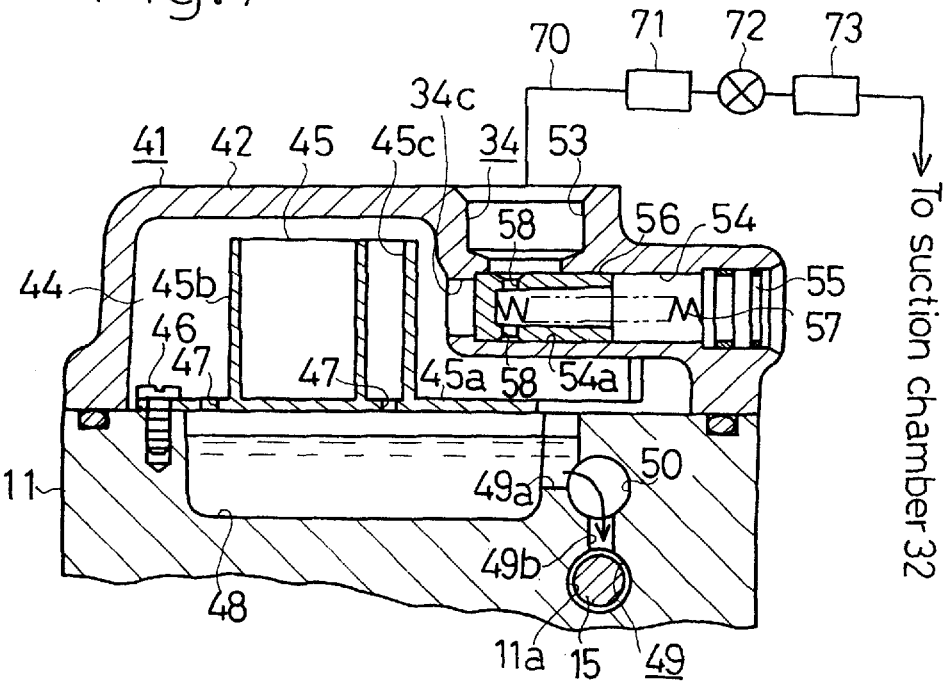
FIG. 7 is a cross-sectional view taken along line 7—7 of FIG. 5.

When the compressor is stopped, the pressure in the separation chamber 44 acting on the closed end of the check valve member 56 is lowered. As a result, the check valve member 56 is moved toward the third port 34*c* by the force of the spring 57 as shown in FIG. 7. This causes the valve member 56 to disconnect the third port 34*c* from the outlet port 53. The separation chamber 44 is thus disconnected from the external refrigerant circuit 70. Back flow of refrigerant gas form the circuit 70 into the chamber 44 is prevented, accordingly.

A plurality of through holes 58 are formed in the peripheral wall of the check valve member 56 with a predetermined interval between each pair of adjacent holes 58. As shown in FIG. 7, the check valve member 56 is moved to a position for closing the discharge passage 34 when the operation of the compressor is stopped. At this time, more than one through hole 58 communicates the interior of the valve member 56 with the outlet port 53. This allows the highly pressurized refrigerant gas in the external refrigerant circuit 70 to enter the interior of the check valve member 56 via the outlet port 53 and the through hole 58. The refrigerant gas quickens the movement of the check valve member 56 to the closed position and securely retains the valve member 56 at the closed position.

The operation of the above described variable displacement compressor of FIG. 1 will now be described.

When the rotary shaft 16 is rotated by an external power source, the rotor 22 rotates integrally with the shaft 16. This also causes the swash plate 26 to integrally rotate, thereby reciprocating the pistons 20 with a stroke corresponding to the inclination of the swash plate 26. When each piston 20 moves from the top dead center to the bottom dead center, refrigerant gas in the suction chamber 32 is drawn into the associated cylinder bore 19 through the suction port 36. When each piston 20 moves from the bottom dead center to the top dead center, refrigerant gas in the cylinder bore 19 is compressed to reach a certain pressure level and is then discharged to the discharge chamber 33 through the discharge port 38. When the compressor is operating in the above manner, the rotating rotor 22 and the swash plate 26 agitate lubricant stored in the lower portion of the crank chamber 21, thereby diffusing the lubricant in the refrigerant gas. The misted lubricant lubricates each sliding part in the crank chamber 21.

When the compressor is operated, refrigerant gas flows from the discharge chamber 33 to the first port 34*a* of the discharge passage 34. The pressure of the gas moves the lubricant supplying valve member 51 toward the connecting groove 49*a* as shown in FIGS. 1 to 3. As it is moved toward the groove 49*a,* the valve member 51 opens the discharge passage 34 and closes the lubricant supplying passage 49. This allows refrigerant gas to flow from the discharge chamber 33 into the separation chamber 44 through the discharge passage 34. Further, refrigerant gas flows from the separation chamber 44 to the third port 34*c* of the discharge passage 34. The pressure of the gas moves the check valve member 56 away from the third port 34*c*. As it is moved away from the third port 34*c*, the valve member 56 opens the discharge passage 34. Accordingly, the refrigerant gas is discharged from the separation chamber 44 to the external refrigerant circuit 70 via the discharge passage 34.

The refrigerant gas flowing through the separation chamber 44 revolves around the cylinder 45*b*. Centrifugation caused by the revolution separates the misted lubricant contained in the refrigerant gas from the refrigerant gas. The separated lubricant is stored in the lubricant storing chamber 48.

When the compressor is stopped, the lubricant supplying valve member 51 is moved away from the connecting groove 49*a* as shown in FIGS. 5 and 6. This causes the valve member 51 to close the discharge passage 34 and opens the lubricant supplying passage 49. The lubricant in the storing chamber 48 is thus supplied to the crank chamber 21 through the passage 49. Further, as shown in FIG. 7, the check valve member 56 is moved toward the third port 34*c*. This causes the valve member 56 to close the discharge passage 34. The separation chamber 44 is thus disconnected from the external refrigerant circuit 70.

The expected effects and advantages of the first embodiment will hereinafter described.

When the compressor is stopped, the lubricant supplying valve member 51 opens the lubricant supplying passage 49 for supplying lubricant in the storing chamber 48 to the crank chamber 21. Therefore, when the compressor is started again, sufficient amount of lubricant is stored in the crank chamber 21. Lubrication failure when the compressor is started is thus avoided.

The lubricant supplying valve member 51 forms part of a spool valve that is operated based on the difference between the pressure in the discharge chamber 33 and the pressure in the storing chamber 48. In other words, the valve employing the valve member 51 is automatically and selectively opened and closed by starting and stopping the compressor. Therefore, the valve employing the valve member 51 does not have to be controlled by a control unit located outside the compressor. This simplifies the structure and control of the valve.

The check valve member 56 is located in the discharge passage 34, which is arranged in the downstream portion of the lubricant separating mechanism 41. When the compressor is stopped, the check valve member 56 closes the discharge passage 34 for disconnecting the separation chamber 44 from the external refrigerant circuit 70. This prevents the highly pressurized refrigerant gas in the circuit 70 from flowing back to the crank chamber 21 via the separation chamber 44 and the lubricant supplying passage 49 when the compressor is stopped. The pressure in the crank chamber 21 is thus prevented from being excessively high. This improves the durability of the lip seal 18, which seals the crank chamber 21, and prevents noise, which would otherwise be caused by the flow of highly pressurized gas from the circuit 70 to the crank chamber 21.

The discharge passage 34 located in the downstream portion of the lubricant separating mechanism 41 has the right angle portion. The check valve member 56 is arranged to face the right angle portion of the passage 34. Forming a linear discharge passage for accommodating a check valve requires a large space in the compressor. However, the space required for forming the discharge passage 34 for accommodating the check valve member 56 is relatively small. This reduces the size of the compressor.

The check valve member 56 has a plurality of the through holes 58 formed in its peripheral wall. When the compressor is stopped and the check valve member 56 is moved to a position closing the discharge passage 34, more than one through hole 58 communicates the interior of the valve member 56 with the outlet port 53. This allows highly pressurized refrigerant gas in the refrigerant circuit 70 to flow into the check valve member 56 through the outlet port 53 and the through hole 58. The gas quickens the movement of the check valve member 56 to the closed position and then positively retains the valve member 56 at the closed position. This securely prevents the highly pressurized gas in the circuit 70 from flowing back to the crank chamber 21.

The spring 57 engages the check valve member 56 for urging the valve member 56 to the closed position. Therefore, when the compressor is stopped, the valve member 56 is more quickly moved to the closed position. Further, the spring 57 more securely retains the valve member 56 at the closed position.

Figure 8:
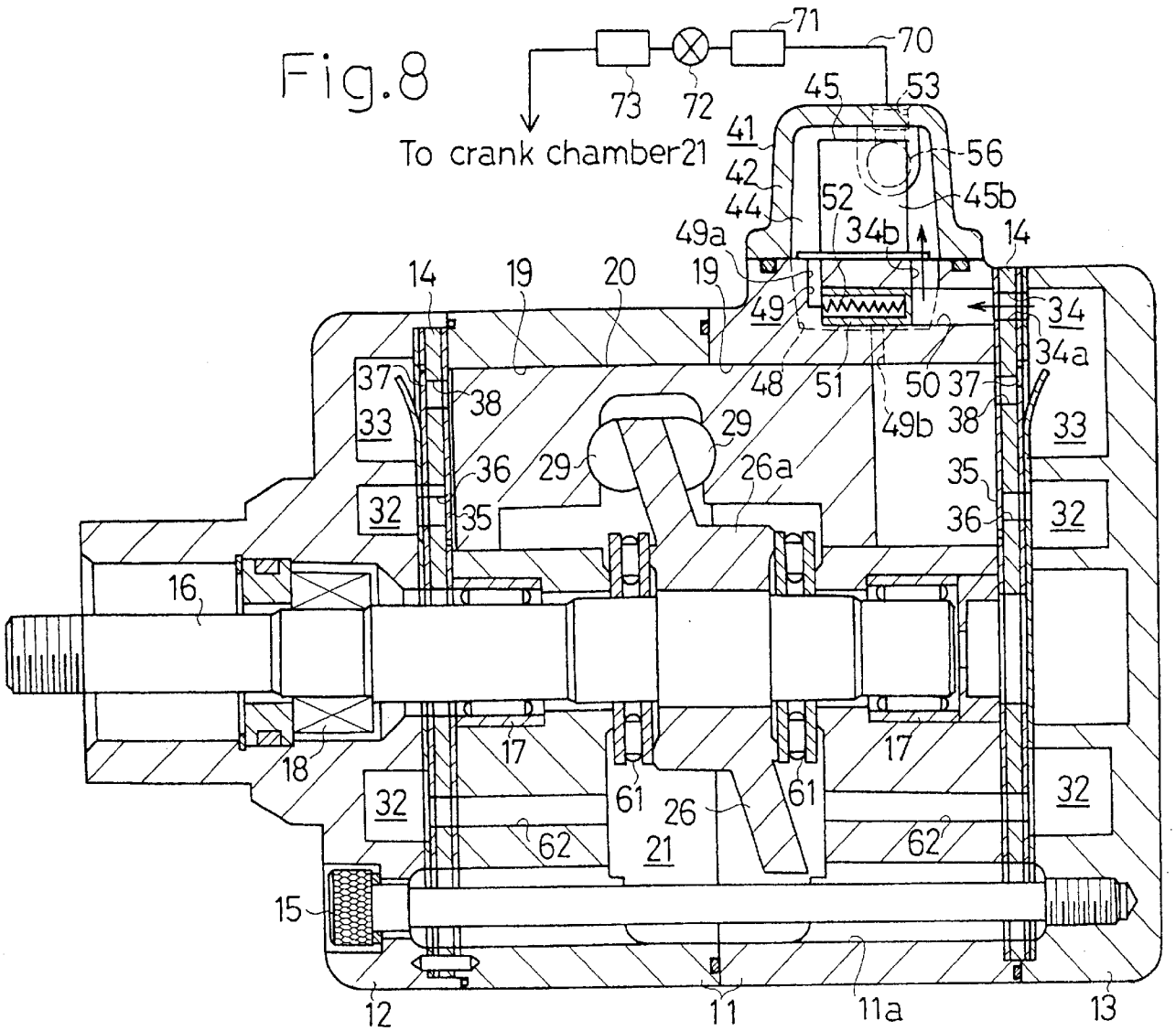
FIG. 8 is a cross-sectional view illustrating a compressor according to a second embodiment of the present invention.

A second embodiment of a double-headed piston type fixed displacement compressor according to the present invention will now be described with reference to FIG. 8. The differences from the first embodiment will mainly be discussed below, and like or the same reference numerals are given to those components that are like or the same as the corresponding components of the first embodiment.

A pair of front cylinder blocks 11 are coupled to each other at their opposed ends. A front housing 12 and a rear housing 13 are coupled to the front and rear ends of the connected cylinder blocks 11 with a valve plate 14 arranged therebetween, respectively. The housings 12, 13 are fastened to the cylinder blocks 11 by a plurality of bolts 15.

A plurality of pairs of cylinder bores 19 are defined in the cylinder blocks 11. A double-headed piston 20 is accommodated in each pair of cylinder bores 19. A swash plate 26 is secured to the rotary shaft 16 and located in the crank chamber 21. The swash plate 26 is connected to the middle of each piston 20 by a pair of semispheric shoes 29.

A pair of thrust bearings 61 are arranged between the front and rear surfaces of a boss 26*a* of the swash plate 26 and the cylinder blocks 11. The thrust bearings 61 hold the swash plate 26 between the cylinder blocks 11. When the compressor is operating, the thrust load acting on the swash plate 26 is received by the cylinder blocks 11 through the thrust bearings 61.

Annular suction chambers 32 are defined in the front and rear housings 12, 13, respectively. Each suction chamber 32 is connected to the external refrigerant circuit 70 by a suction passage 62 and the crank chamber 21. An annular discharge chambers 33 is formed in the periphery of the front and rear housings 12, 13 about the suction passages 32, respectively. The discharge chambers 33 are connected with each other by a passage (not shown) formed in the cylinder blocks 11. The discharge chamber 33 in the rear housing 13 is communicated with the first port 34*a* of the discharge passage 34.

Each valve plate 14 has a plurality of suction valves 35 and a plurality of discharge valves 37. Each suction valve 35 and each discharge valve 37 correspond to one of the pairs of cylinder bores 19. As each piston 20 moves from the top dead center to the bottom dead center in the associated cylinder bore 19, refrigerant gas in the corresponding suction chamber 32 is drawn into the cylinder bore 19 through the associated suction port 36 and the associated suction valve 35. As each piston 20 moves from the bottom dead center to the top dead center in the associated cylinder bore 19, refrigerant gas is compressed in the cylinder bore 19 and discharged to the associated discharge chamber 33 through the associated discharge port 38 and the associated discharge valve 37.

A lubricant separating mechanism 41 and a lubricant storing chamber 48 are formed in the top peripheral portion of the rear cylinder block 11. The mechanism 41 and the storing chamber 48 have the same construction as those of the first embodiment. A lubricant supplying passage 49 is formed in the rear cylinder block 11. Similar to the first embodiment, the passage 49 communicates the storing chamber 48 with the crank chamber 21 and a discharge passage 34 is formed in the downstream portion of the mechanism 41. Further, a lubricant supplying valve member 51 is located in the passage 49, and a check valve member 56 is located in the discharge passage 34.

The compressor according to the second embodiment thus has the same effects and advantages as the compressor of the first embodiment. In the compressor of the second embodiment, the suction chambers 32 are connected to the external refrigerant circuit 70 with the crank chamber 21 in between. In this type of compressor, stopping the compressor may cause highly pressurized refrigerant gas of a high temperature in the external refrigerant circuit 70 to flow back to the crank chamber 21 through the discharge passage 34 and the lubricant supplying passage 49. If it flows back to the crank chamber 21, the gas then further flows back to the evaporator 73 in the circuit 70. However, similar to the first embodiment, the check valve member 56 of FIG. 8 closes the discharge passage 34 for preventing the back flow of refrigerant gas from the circuit 70 to the crank chamber 21 when the compressor is stopped. Therefore, the refrigerant gas does not flow back from the crank chamber 21 to the evaporator 73 in the circuit 70. This prevents the temperature of the evaporator 73 from being increased by the high temperature refrigerant gas, thereby improving the refrigeration efficiency of the air conditioner.

The present invention may be alternatively embodied in the following forms:

In the first and second embodiments, the lubricant supplying valve member 51 may be controlled by command signals from a control unit located outside the compressor.

In the first and second embodiments, the spring 57 that urges the check valve member 56 toward the closed position, may be omitted. In this case, the check valve member 56 is moved to the closed position by a decrease in pressure in the separation chamber 44, which acts on the closed end of the valve member 56, and the pressure of the refrigerant gas flowing in the check valve member 56 through the hole 58.

In the first and second embodiments, the through holes 58 of the check valve member 56 may be omitted. In this case, the check valve member 56 is moved to the closed position by a decrease in pressure in the separation chamber 44, which acts on the closed end of the valve member 56, and the force of the spring 57.

In the first embodiment, the compressor may be a fixed displacement type. In this case, the swash plate 26 is fixed to the rotary shaft 16

In the second embodiment, the compressor may be a variable displacement type. In this case, the compressor has a displacement control valve and a mechanism for varying the inclination of the swash plate 26. The control valve, for example, controls pressure that is communicated with the inclination varying mechanism from the discharge chamber in order to operate the mechanism.

In the second embodiment, the swash plate 26 may be replaced with a wave cam plate having a wavy cam surface on each of two sides.

The present invention may be adapted to a wobble plate type compressor. In this case, the swash plate 26, which rotates integrally with the rotary shaft 16, is replaced with a wobble plate. The wobble plate rotates with respect to the rotary shaft 16 and is connected to each piston by a rod.

Therefore the present examples and embodiments are to be considered as illustrative and not restrictive and the invention is not to be limited to the detailed given herein but may be modified within the scope of the appended claims.

What is claimed is:

1. A compressor for compressing gas containing misted oil, the compressor having a drive plate located in a crank chamber and mounted on a drive shaft and a piston operably coupled to the drive plate and located in a cylinder bore, wherein said drive plate converts rotation of the drive shaft to reciprocating movement of the piston in the cylinder bore to vary the capacity of the cylinder bore, said piston compressing gas supplied to the cylinder bore and discharging the compressed gas from the compressor by way of a discharge chamber and a discharge passage, said compressor comprising:

an oil separating mechanism disposed midway in the discharge passage to separate the oil from the gas flowing in the discharge passage;

a storing chamber defined in the lower portion of the separating mechanism to store the oil separated from the gas;

a supplying passage for connecting the storing chamber with the crank chamber to supply the oil to the crank chamber from the storing chamber; and a supplying valve disposed midway in the supplying passage, wherein said supplying valve opens the supplying passage to supply the oil to the crank chamber from the storing chamber when the compressor is stopped.

2. The compressor according to claim 1, wherein said supplying valve includes a spool valve that is operated in response to the difference between the pressure in the discharge chamber and the pressure in the storing chamber.

3. The compressor according to claim 2, wherein said supplying valve includes a valve member movable between a first position and a second position, said valve member opening the supplying passage in the first position and closing the supplying passage in the second position, wherein said valve member has a first surface and a second surface opposite to the first surface, said first surface receiving the pressure in the discharge chamber, said second surface receiving the pressure in the storing chamber.

4. The compressor according to claim 3, wherein said supplying valve includes a member for urging the valve member toward the first position.

5. The compressor according to claim 1 further comprising a check valve disposed midway in the discharge passage located downstream of the separating mechanism, wherein said check valve allows only the gas to be discharged from the compressor.

6. The compressor according to claim 5, wherein said check valve includes a valve body movable between a third position and a fourth position, said valve body opening the discharge passage in the third position and closing the discharge passage in the forth position, wherein said valve body moves to the third position to allow the gas to be discharged from the compressor when the compressor is operating, and wherein said valve body moves to the forth position when the compressor is stopped.

7. The compressor according to claim 6, wherein said discharge passage located downstream of the separating mechanism has a turn portion, wherein said valve body faces the turn portion.

8. The compressor according to claim 7, wherein said valve body has an outer end surface for receiving the pressure in the discharge passage located upstream of the valve body, wherein said valve body selectively opens and closes the discharge passage in response to the pressure acting on said outer end surface.

9. The compressor according to claim 8, wherein said valve body includes:

a hollow cylinder that has a closed end;

a receiving surface opposite to the outer end surface and provided with the interior of the valve body; and a through hole formed in the peripheral wall of the valve body, wherein said through hole connects the interior of the valve body with the discharge passage located downstream of the valve body to apply the pressure in the discharge passage located downstream of the valve body to the receiving surface when the valve body moves to the forth position in accordance with the stopping of the compressor.

10. The compressor according to claim 8, wherein said check valve includes a member for urging the valve body toward the forth position.

11. A compressor for compressing gas containing misted oil, the compressor having a housing having a crank chamber, a drive plate located in the crank chamber and mounted on a drive shaft and a piston operably coupled to the drive plate and located in a cylinder bore, wherein said drive plate converts rotation of the drive shaft to reciprocating movement of the piston in the cylinder bore to vary the capacity of the cylinder bore, said piston compressing gas supplied to the cylinder bore from a separate external circuit by way of a suction chamber and discharging the compressed gas to the external circuit by way of a discharge chamber and a discharge passage, said compressor comprising:

an oil separating mechanism disposed midway in the discharge passage to separate the oil from the gas flowing in the discharge passage;

a storing chamber defined in the lower portion of the separating mechanism to store the oil separated from the gas;

a supplying passage for connecting the storing chamber with the crank chamber to supply the oil to the crank chamber from the storing chamber;

a supplying valve disposed midway in the supplying passage, wherein said supplying valve opens the supplying passage to supply the oil to the crank chamber from the storing chamber when the compressor is stopped; and a check valve disposed midway in the discharge passage located downstream of the separating mechanism, wherein said check valve allows only the gas to be discharged from the discharge chamber to the external circuit.

12. The compressor according to claim 11, wherein said supplying valve includes a spool valve that is operated in response to the difference between the pressure in the discharge chamber and the pressure in the storing chamber.

13. The compressor according to claim 12, wherein said supplying valve includes a valve member movable between a first position and a second position, said valve member opening the supplying passage in the first position and closing the supplying passage in the second position, wherein said valve member has a first surface and a second surface opposite to the first surface, said first surface receiving the pressure in the discharge chamber, said second surface receiving the pressure in the storing chamber.

14. The compressor according to claim 13, wherein said supplying valve includes a member for urging the valve member toward the first position.

15. The compressor according to claim 14, wherein said check valve includes a valve body movable between a third position and a forth position, said valve body opening the discharge passage in the third position and closing the discharge passage in the forth position, wherein said valve body moves to the third position to allow the gas to be discharged from the discharge chamber to the external circuit when the compressor is operating, and wherein said valve body moves to the forth position when the compressor is stopped.

16. The compressor according to claim 15, wherein said discharge passage located downstream of the separating mechanism, has a turn portion, wherein said valve body faces the turn portion.

17. The compressor according to claim 16, wherein said valve body has an outer end surface for receiving the pressure in the discharge passage located upstream of the valve body, wherein said valve body selectively opens and closes the discharge passage in response to the pressure acting on said outer end surface.

18. The compressor according to claim 17, wherein said valve body includes:

a hollow cylinder that has a closed end;

a receiving surface opposite to the outer end surface and provided with the interior of the valve body; and a through hole formed in the peripheral wall of the valve body, wherein said through hole connects the interior of the valve body with the discharge passage located downstream of the valve body to apply the pressure in the external circuit by way of the discharge passage to the receiving surface when the valve body moves to the forth position in accordance with the stopping of the compressor.

19. The compressor according to claim 18, wherein said check valve includes a member for urging the valve body toward the forth position.

20. The compressor according to claim 11 further comprising a suction passage for connecting said crank chamber with said suction chamber, wherein the gas is supplied to the suction chamber from the external circuit by way of the crank chamber and the suction passage.

* * * * *

UNITED STATES PATENT AND TRADEMARK OFFICE

CERTIFICATE OF CORRECTION

PATENT NO. : 5,823,294

DATED : October 20, 1998

INVENTOR(S) : Mizutani, Kayukawa, Hirota, Enokijima

It is certified that error appears in the above-identified patent and that said Letters Patent is herel corrected as shown below:

In column 1, line 25: change "host" to –heat--.

In column 2, line 19: change "stet" to –set--.

In column 3, line 38: change "boxes" to –bores--.

In column 3, line 53: change "bore" to –bores--.

In column 10, line 6: change "detailed" to –details--.

Signed and Sealed this

Twenty-seventh Day of July, 1999

*Attest:*

Q. TODD DICKINSON

*Attesting Officer*

*Acting Commissioner of Patents and Trademarks*